US005347721A

United States Patent [19]

Asterino, Jr.

[11] Patent Number: 5,347,721

[45] Date of Patent: Sep. 20, 1994

[54] METHOD AND DEVICE FOR DRAWING CURVED LINES

[76] Inventor: William M. Asterino, Jr., 440 Peppermill Ct., Sewell, N.J. 08080

[21] Appl. No.: 38,655

[22] Filed: Mar. 30, 1993

[51] Int. Cl.[5] ..... B43L 9/00

[52] U.S. Cl. ..... 33/27.01; 33/27.04; 33/565; 33/27.03

[58] Field of Search ..... 33/27.01, 27.02, 27.04, 33/27.07, 27.11, 27.12, 30.1, 30.2, 435, 565, 566, 562, 1 SD, 27.03

[56] References Cited

U.S. PATENT DOCUMENTS

| | | | |
|---|---|---|---|
| 776,897 | 12/1904 | Ferris . | |
| 893,085 | 7/1908 | Loughborough . | |
| 1,154,673 | 9/1915 | Van Ness . | |
| 1,327,154 | 1/1920 | Golden . | |
| 1,402,629 | 1/1922 | Manly . | |
| 1,801,404 | 3/1929 | Will . | |
| 1,808,705 | 6/1931 | Owen, Jr. . | |
| 1,825,266 | 9/1931 | Fischer . | |
| 2,943,392 | 7/1960 | Attridge . | |
| 3,460,261 | 8/1969 | Frey . | |
| 3,465,445 | 9/1969 | Fisher . | |
| 3,568,327 | 3/1971 | Furuoka | 33/565 |
| 4,129,948 | 12/1978 | Hatter et al. . | |
| 4,530,156 | 7/1985 | Kettlestrings . | |
| 5,125,161 | 6/1992 | Guthrie | 33/27.03 |

*Primary Examiner*—William A. Cuchlinski, Jr.
*Assistant Examiner*—Alvin Wirthlin
*Attorney, Agent, or Firm*—Eckert Seamans Cherin & Mellott

[57] ABSTRACT

A drafting tool for drawing a circle or curved arc has interlocked, independently rotatable concentric rings. The rings have radially extending openings that can be aligned to form a radial track. A carriage for carrying a pencil or other marking element is slidable along the track to a desired radial position. The carriage can occupy one or more than one of the rings and rotates with the ring(s) around a center point. The carriage has a locking structure that is spring biased to retract and advances to lock the carriage in position at the desired radius when the pencil or the like is inserted. The locking structure can have a tooth for engaging between teeth along the radial openings in the track, the teeth on the track forming part of the sliding support for the carriage. The rings have complementary tongues and grooves, and nodules on at least one of the abutting surfaces of the tongues and grooves minimizes surface contact to reduce friction. The rings, and preferably a central disk, are secured in a rectangular base having anti-skid pads.

18 Claims, 4 Drawing Sheets

METHOD AND DEVICE FOR DRAWING CURVED LINES

BACKGROUND OF THE INVENTION

1. Field of the Invention

The invention relates to a method and apparatus for drawing curved lines, particularly circles. More specifically the invention relates to a device which provides easy selection of desired curved line radius and which is easy for use to draw a near perfect curved line or circle having the selected radius.

2. Prior Art

Various drafting tools for drawing curved lines, arcs and circles are known in the drafting and design industries. A basic example is the compass. The typical compass is a V-shaped device having a pair of rigid arms connected at a hinge allowing the arms to be separated to any angle in a continuous span of adjustment. One of the arms carries a writing implement at the end, and the end of the other arm has a sharp point that pierces the writing surface to provide a central anchor or pivot about which the compass is rotated to draw an arc. If used properly, it is possible to draw a perfect circle using a compass. However, it is not always easy to do so. Frequently, the pointed arm is displaced from the pivot point while drawing. The separation of the arms sometimes can be changed inadvertently while drawing. These changes introduce imperfections in the drawn circle.

Accuracy of drawings is important. Accordingly, various devices are available to aid draftspersons to draw accurately, including devices for drawing curved lines and circles. U.S. Pat. No. 776,897—Ferris discloses a ruler having a pencil holding slide and a centering slide. Each slide is longitudinally adjustable along the length of the ruler. When used as a compass, a pin is depressed to engage and anchor the ruler to a paper surface. A writing device is inserted through an opening and engages the paper surface. The ruler can then be rotated about the pin for drawing arcs or circles of desired radii.

U.S. Pat. No. 893,085—Loughborough discloses a drafting instrument having a plurality of apertures for receiving a marking pen or pencil point. A moveable pin defines the point of rotation of the device, which is suited for use as a compass to draw circles.

U.S. Pat. No. 1,154,673—Van Ness discloses a drafting tool which combines the attributes of a T-square, triangle and protractor.

U.S. Pat. No. 1,327,154—Golden discloses a compass having a centering point and a bar. The bar extends radially from a disc. A longitudinal slot extending the length of the bar contains a slide which moves along the graduated surface of the bar. The slide has an enlargement with components for securing a piece of lead or the like. The lead can be rotated about the centering point to draw a circle of the desired size.

U.S. Pat. No. 1,402,629—Manly discloses a rule having a centering point and slot. A pencil carrier rides in the slot. A set screw secures the pencil carrier in position along the slot. Rotation of the device around the centering point produces a circle.

U.S. Pat. No. 1,808,705—Owen, Jr. discloses a combination compass, protractor and ruler. The device has a centering eyelet rotatably engaged in one end of a body. A plurality of openings are provided for receiving a pencil point or the like. In another embodiment, a slot carries a guide device. The guide device accepts a pencil point or the like and is slidable within the slot for drawing a circle or arc having the desired radius.

U.S. Pat. No. 1,825,266—Fischer discloses a combination ruler and compass having a pivot element and apertures for receiving a pencil point. In another embodiment, Fischer discloses a ruler and compass having a pivot element and a slide in a slot. The slot is adapted to receive a writing instrument.

U.S. Pat. No. 2,943,392—Attridge discloses a beam compass having a centering point and pencil carrier mounted on a track.

U.S. Pat. No. 3,460,261—Frey discloses a drafting device having a frame-like support member. An elongated, rotatable member is mounted within an opening of the support member. The rotatable member has an aperture for accepting a pencil point or the like. The rotatable member is rotated within the support member to draw circles or arcs of desired radii.

U.S. Pat. No. 3,465,445—Fischer discloses a drawing design apparatus which includes a plurality of concentrically arranged rings, each having a plurality of apertures for drawing circles having varying radii.

U.S. Pat. No. 4,129,948—Hatter et al discloses a circle drawing device having a flat circular disk having a hardened steel center pin. The disk has a plurality of holes for accepting a drafting instrument. The entire disk rotates about the center pin to draw circles.

U.S. Pat. No. 4,530,156—Kettlestrings discloses a rotatable disk for drawing circles. Kettlestrings discloses a non-concentric rotatable disk located within a first rotatable disk. The non-concentric rotatable disk is rotated to a desired point to provide a circle of desired radius. The non-concentric rotatable disk can be locked into place while the first rotatable disk is rotated about a center to draw the circle.

U.S. Pat. No. 4,125,161—Guthrie discloses a circle drafting instrument having a slotted disk rotating within a support member. The slotted disk has a plurality of slots, each having a plurality of wedge shaped notches for placement of the point of a drawing instrument.

These and other prior art disclosures show that rotating disks having apertures for accepting the point of a pencil or the like are known as a means for drawing curved lines or circles. The disks function in lieu of the pivotable legs of the V-shaped compass or the fixed distance between the pivot point and pencil apertures of an elongated rule, to locate the pencil point at a set distance from the pivot point for drawing a curved line or circle. Typically, the user chooses among fixed pencil apertures at different radii, however slide mechanisms that are movable to set the pencil or other drawing instrument at a desired radius also are known.

Rotatable disks having a plurality of fixed holes for accepting the point of a writing instrument do not permit an inadvertent change in radius during drawing, and generally provide near perfect curved lines and circles. However, it is only possible to draw a circle at one of the discrete intervals defined by the fixed holes. It is possible to provide many holes at different radii, but such holes cannot span the entire radius. The sliding structure precludes holes, for example, close to the junctions between the rings.

A device such as an elongated ruler having a slide mechanism, for positioning a pencil point at any desired radius within an adjustment range, enables more precise selection of the circle radius. However, the device is subject to the same dislocations as a compass, such as dislocation of the pivot point from the paper and consequent imperfection of the drawn circle.

It would be desirable to provide a device for drawing curved lines or circles that can make near perfect circles like a rotating disk type drafting tool, and also has means to select a desired radius within a range of adjustment as provided by the sliding pencil aperture type drafting tool. Such a device according to the present invention has the adjustment advantages of a compass and the fixed center and radius advantages of a rotating disk guide.

SUMMARY OF THE INVENTION

It is an object of the invention to provide a tool for drawing curved lines accurately.

It is another object of the invention to provide a tool for drawing curved lines, especially circles and circular arcs, which requires little skill to use.

Another object of the invention is to provide a tool for drawing curved lines, especially circles, capable of consistently holding a uniform radius while drawing.

Yet another object of the invention is to provide a tool for drawing curved lines and circles which provides great latitude in selection of curved line or circle radius.

These and other objects are accomplished according to the invention in a compass gauge or template with sliding concentric rings and a radial track for holding a writing instrument at a selected radius. The sliding concentric rings preferably are formed by a plurality of plastic rings that are interlocked by complementary tongues and grooves along outer circumferential edges of each inner ring and inner circumferential edges of the adjacent outer rings. The tongues and grooves can face radially outward or inward, or can alternate. The tongue and groove joints snap together to interlock the rings while allowing rotation of one ring with respect to another or any ring with respect to the remaining rings. Small nodules or bumps preferably protrude on the surface of one of the tongue and the corresponding groove. The nodules offset the surfaces of an interlocked tongue/groove joint and reduce friction by reducing the area of surface contact, permitting smooth, easy rotation of the rings. Preferably, the device has a square base in which the interlocked rings fit, to maintain the tool in a neat, portable package and to reference the tool to an edge such as the edge of a T-square. The square base has a circular opening receiving the largest of the interlocked concentric rings. The circumferential edge of this circular opening is preferably provided with a tongue or groove for movably interlocking with a respective tongue or groove on the outer edge of the outermost concentric ring.

A circular disk is provided at the center of the concentric rings. The circular disk has a tongue or groove about its circumference for rotatably interlocking with a respective tongue or groove on the inner circumference of the next adjacent inner ring.

Each concentric ring, and the center disk, is discontinuous and has a radially extending opening. The openings in the center disk and in the concentric rings are alignable to form a radial channel in the gauge. The edges of the radial channel likewise have either a tongue or groove, and define a sliding track. A carriage for carrying a marking element such as a pen or pencil is secured within the track and is slidable along the radial length of the track so as to pass between the rings and the center disk. The carriage has a tongue or groove to interlock with the tongue or groove on the edges of the radial channel or track. In this manner, the carriage can be slid to a desired radius, whereupon a marking element is inserted in the carriage, for drawing a circle or curved line of a desired radius while guiding the marking element via the rings. The carriage rotates with the respective ring or with the center disk, about the center of the disk. The center disk or concentric ring(s) carrying the carriage rotate with the carriage relative to the remaining concentric rings or base. Whereas the carriage can span across the junction between rings, it is possible to draw a circle at any radius, including the radius of the junction.

To facilitate drawing circles or curved lines having a uniform radius, the carriage is lockable in place along the track to prevent radial carriage movement as the carriage is rotated. The locking element can consist of a plurality of notches disposed on one side of the track and a spring biased tooth located in the carriage. The tooth is movable to protrude upon insertion of the writing instrument, for engaging between notches along the track and fixing the carriage at the desired radius.

DETAILED DESCRIPTION OF THE PREFERRED EMBODIMENTS

Figure 1:
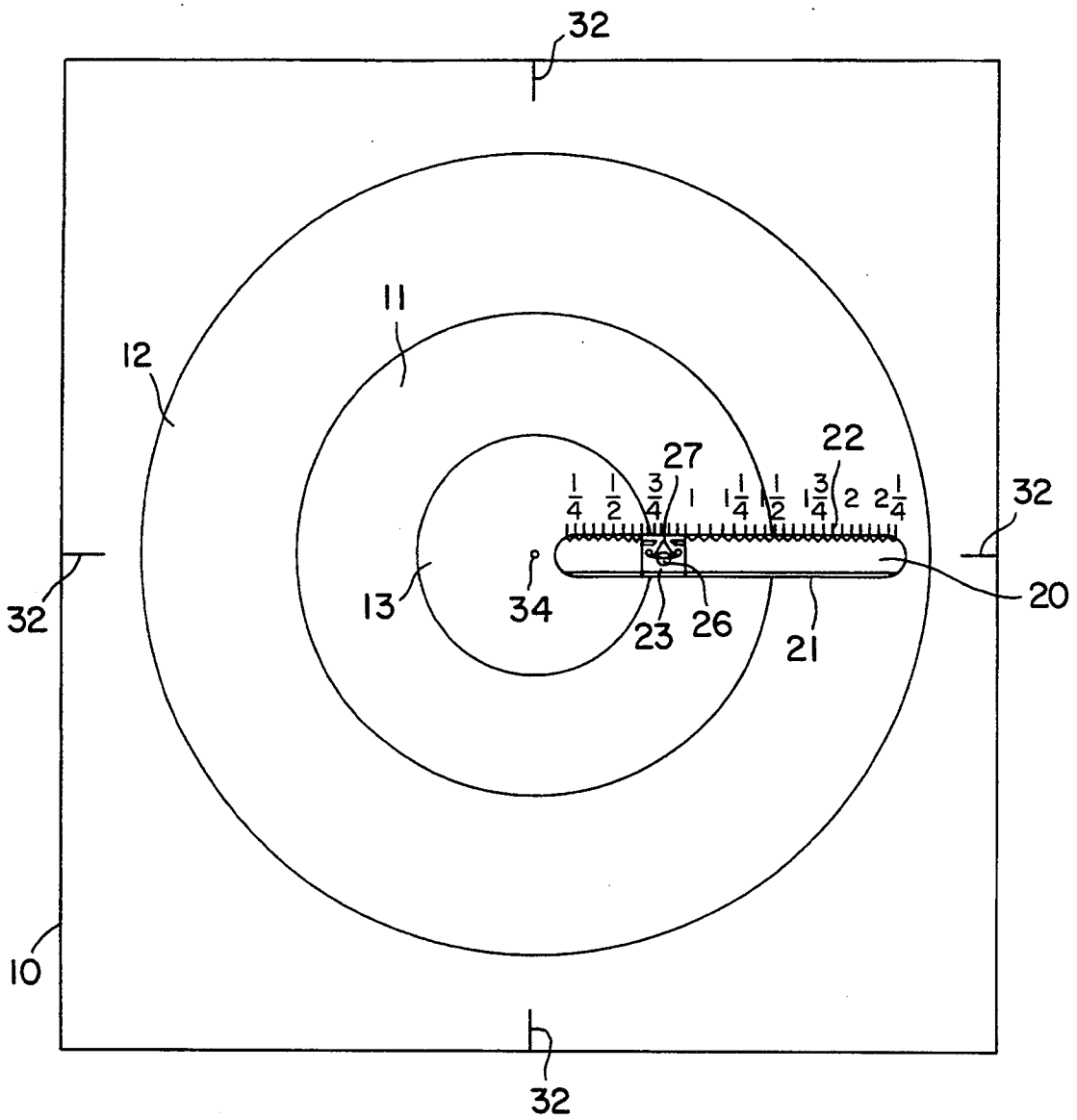
FIG. 1 is a top view of a drafting tool according to the invention.

A drafting tool according to the invention as shown in FIG. 1 includes a base 10. Base 10 is preferably clear or transparent to enable a user of the drafting tool to view the surface on which circles or curved lines are being drawn, and preferably is constructed from a lightweight, flexible plastic of the type used to construct drafting tools such as templates, protractors and the like. Base 10 has a large, round hole in its center, within which are disposed a plurality of concentric rings 11 and 12 and a center disk 13. Each of concentric ring 11, outer concentric ring 12 and center disk 13 are freely rotatable with respect to one another and with respect to base 10. Although the invention is shown in FIG. 1 as having two concentric rings, it is within the scope of the invention to have more than two, and the number of concentric rings can depend on the size of the drafting tool itself (i.e., more rings for a larger tool). Concentric rings 11 and 12 and center disk 13 are preferably made of the same lightweight, transparent plastic as base 10.

Figure 2:
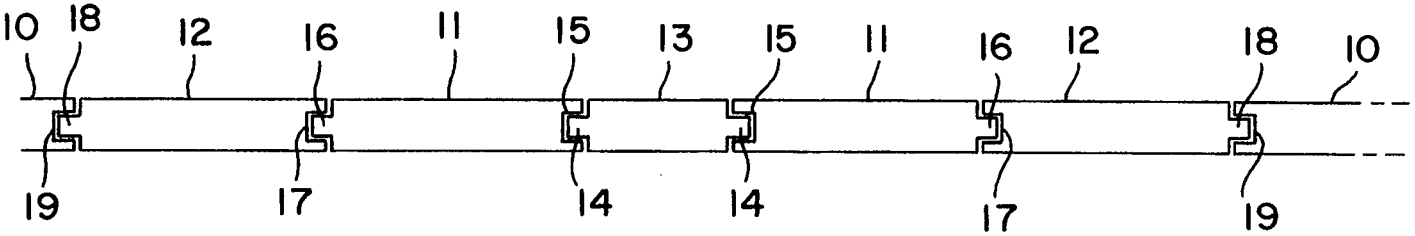
FIG. 2 is a side cut-away view of the drafting tool of the invention showing the interlocking of the rings.

Each of concentric ring 11, outer concentric ring 12 and center disk 13 are interlocked using a tongue and groove connection. For example, as shown in FIG. 2, center disk 13 has tongue 14 disposed about its circumference. Inner concentric ring 11 has an inner circumference having a circumferentially disposed groove 15. Tongue 14 of center disk 13 interlocks with groove 15 of inner concentric ring 11, permitting relative rotation. Concentric ring 11 likewise has an outer circumference with a circumferential tongue 16. In a like manner as discussed above, outer concentric ring 12 has an inner circumference with a circumferential groove 17. Tongue 16 of inner concentric ring 11 interlocks with groove 17 of outer concentric ring 12.

Outer concentric ring 12 has an outer circumference with a circumferential tongue 18. The circular opening of base 10 has a complementary circumferential groove 19. In this manner, outer concentric ring 12 slidably interlocks to base 10 but is free to rotate with respect to base 10.

The interlocking of the grooves and the tongues of the base, the concentric rings and the disk, prevents the parts of the drafting tool from dislocating from the tool. The tongue and groove interlocking arrangement, although prohibiting separation of the components, allows for smooth rotation of any one of the concentric rings or center disks independently of rotation of the other of such concentric rings and disks or base.

To further prevent separation of the rings and disk, it is preferable to flare or dovetail the distal ends of the tongues as compared to the proximal ends immediately adjacent the ring or disk body. Correspondingly, the grooves should flare inwardly into the ring or disk body to conform to the shape of the flared tongues. Flared construction of the tongues and grooves provides substantial protection against separation of the rings and disk, especially against forces directed radially to the tool. The plastic material is sufficiently resilient that the tongues and grooves can snap together notwithstanding the flares. Ring and disk rotation is not inhibited.

Figure 3:
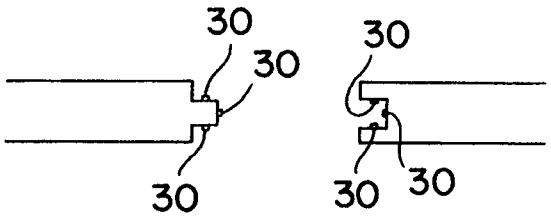
FIG. 3 is a side cut-away view showing antifriction nodules for facilitating ring and disk rotation.

As shown in FIG. 3, a preferred method of reducing friction and providing smooth rotation of the grooves and disks with respect to one another is to provide nodules 30, protruding along the surface of one of an interlocked tongue or groove. The nodules prevent full surface contact of the surfaces of the tongue and groove, and reduce friction. Surface contact is limited to the peak of the nodules. The nodules can be provided on any or all of the three surfaces of engagement between the tongue and groove.

Although FIG. 3 depicts nodules on a tongue and on a groove, it is understood that at an interlocked joint, only one of the tongue or groove bears nodules. Otherwise, opposing nodules would obstruct rotation.

The embodiment of the invention shown and described has a particular arrangement of grooves and tongues, for example grooves on inner circumferences of the concentric rings and tongues on the outer circumferences. Any other combination is within the scope of the invention, as long as adjacent parts provide a complementary groove/tongue pair for interlocking. Other methods of joining the adjacent rings and disks are also possible so long as the method of joining does not inhibit independent rotation.

Figure 4:
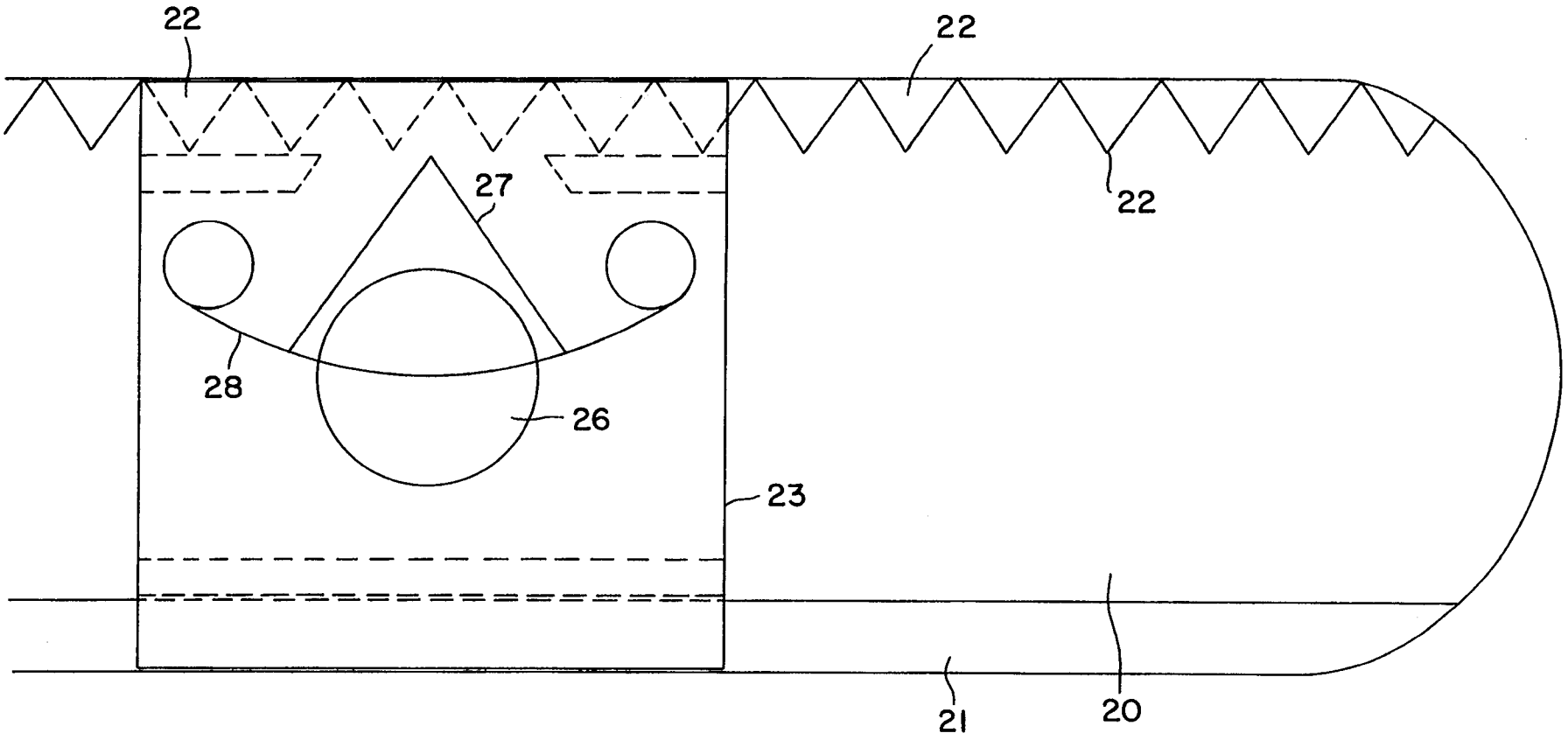
FIG. 4 is a top view of the carriage mechanism of the drafting tool.
Figure 5:
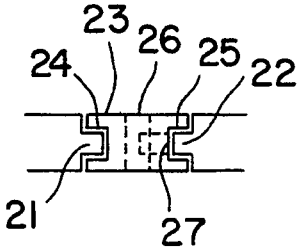
FIG. 5 is a side cut-away view of the carriage mechanism.

Referring to FIGS. 1 and 4, each of center disk 13, inner concentric ring 11 and outer concentric ring 12 are discontinuous. A radially extending opening is provided in each. Alignment of the radial discontinuity in center disk 13, inner concentric ring 11 and outer concentric 12 defines channel 20. Channel 20 is provided with smooth lips 21 on one side and teeth 22 on the other side. However, the carriage is arranged to slide smoothly in that the lips 21 and teeth 22 define a track along channel 20. For example, as shown in FIG. 5, carriage 23 has groove 24 and groove 25 located on its laterally opposite sides. Lip 21 on an inside edge of channel 20 provides tongue-in-groove engagement of carriage 23 within channel 20. In a like manner, teeth 22 interlock with groove 25. Carriage 23 is thus secured within channel 20, but is slidable in a radial direction along the length of channel 20.

The radially extending opening as shown in FIG. 1 runs clear through ring 11. This facilitates assembly of the unit by permitting ring 11 to be deformed more easily to fit over disk 13 and/or within outer ring 12. The radial openings in disk 13 and ring 12 also permit some deformation.

In use, a draftsperson aligns the radial openings in two or more of disk 13, inner concentric ring 11 and outer concentric ring 12 to define channel 20. At this point, the draftsperson can slide carriage 23 to a desired point along channel 20, within the span of more than one ring, for drawing a curved line or circle having a desired radius. Channel 20 preferably is labelled with graduation markings indicating the radius or diameter of the circle which will be provided when the carriage is slid to the particular marked position.

After sliding carriage 23 to a desired location along channel 20, a writing instrument such as a pen or pencil is inserted into aperture 26 of carriage 23. Aperture 26 extends through carriage 23, whereby the point of a writing instrument inserted into aperture 26 will extend to contact the surface upon which a curved line or circle is to be drawn.

Preferably, carriage 23 is provided with spring biased means to fix the radius of the carriage at the desired point by engaging between the carriage and the edges of channel 20. The spring biased means is operated by contact with the writing implement inserted in the carriage, and can have a pad or brake that protrudes to bear against the edges of the channel. In the embodiment shown, the spring biased means includes a tooth 27 that engages between complementary teeth on the edge of the channel. Biasing spring 28 normally retracts the tooth from the edge of the channel such that the carriage can slide in the channel. Upon insertion of a writing instrument into aperture 26, tooth 27 is forced outwardly into engagement with the channel, namely at a notch between teeth 22 in the channel, to secure carriage 23 in position at a desired location along channel 20. This provides a positive engagement, but also limits the device to drawing circles at the radii defined between the teeth 22. Alternatively, a smooth contact surface can be employed, with the tooth 27 replaced by a resilient brake of rubber or the like.

Once carriage 23 is secured in position by insertion of the writing implement, a draftsperson can rotate the carriage to draw a curved line or circle. The section or sections of the drafting tool carrying the carriage, for example the center disk 13, inner concentric 11 or outer concentric ring 12, rotates to carry the carriage around in a circular direction. For example, if carriage 23 is positioned within the channel at inner concentric ring 11, that ring 11 rotates with respect to disk 13 and outer concentric ring 12 as carriage 23 is moved in a circular motion. If carriage 23 is in the area of channel 20 between two sections, such as is shown in FIG. 1 where carriage 23 is partly in center disk 13 and partly in inner concentric ring 11, both center disk 13 and inner concentric ring 11 rotate to carry carriage 23 in its circular path.

Upon removal of the writing instrument from aperture 26, spring 28 retracts tooth 27 out of engagement with the notch between the teeth 22 along the channel, thereby enabling free movement of carriage 23 along channel 20.

Figure 6:
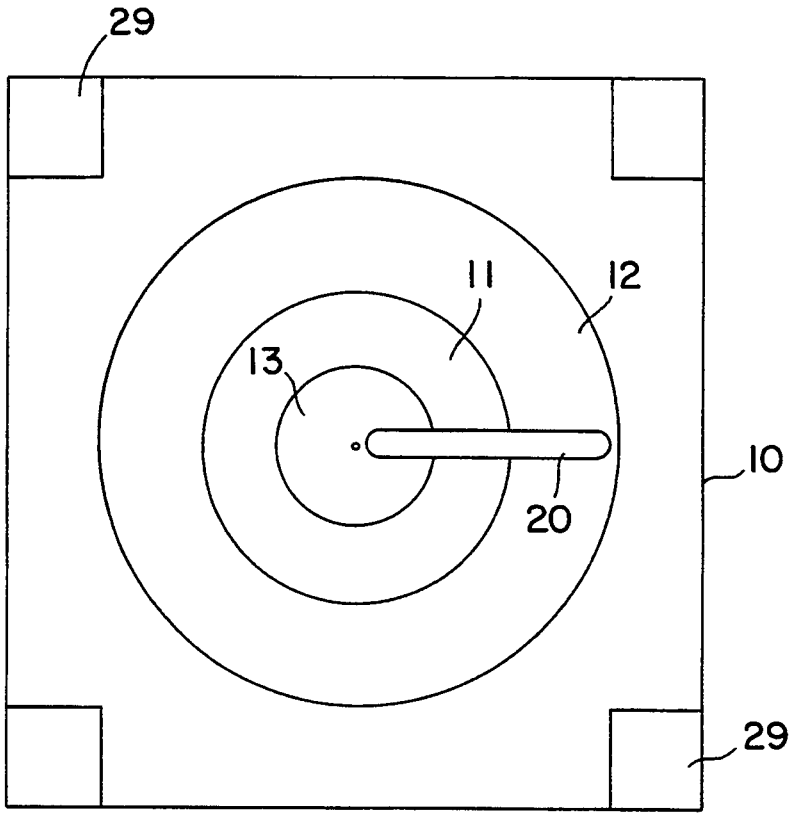
FIG. 6 is a bottom view of the drafting tool.

It is important that the drafting tool remain stationary when in use, to ensure the accuracy of curved lines and circles being drawn. For this reason, and as shown in FIG. 6, in the preferred embodiment of the drafting tool the bottom of base 10 is equipped with thin rubber pads 29. Rubber pads 29 provide a greater degree of friction between base 10 and a drawing surface than would otherwise be provided by the plastic construction of base 10 alone. This friction holds base 10 in position on the drawing surface during use of the tool.

Each edge of base 10 preferably is provided with perpendicularly disposed hash marks 32. Furthermore, the center of center disk 13 has alignment point 34. Hash marks 32 and alignment point 34 are alignable with references on the paper or other medium on which a circle or curved line is to be drawn enabling accurate placement of the curved line or circle.

The drafting tool according to the invention is simple, economical and sturdy. The drafting tool makes it simple, even for persons having no drafting experience, to draw perfect circles and arcs at any desired radius, with the center point and radius of the circle remaining fixed during the process by inherent operation of the tool.

The invention having been disclosed, a number of variations will now become apparent to those skilled in the art. Whereas the invention is intended to encompass the foregoing preferred embodiments as well as a reasonable range of equivalences, reference should be made to the appended claims rather than the foregoing discussion of examples, in order to assist the scope of the invention in which exclusive rights are claimed.

What I claim is:

1. A drafting tool for drawing a curved line comprising:

a plurality of interlocked, independently rotatable concentric rings, said rings being rotatable about a center point, each of said rings having a radially extending opening, the radially extending opening in each of said rings being alignable to define a radially disposed track; and, carriage means structured to carry a marking element, said carriage means being slidable on said track to a desired radial position along said track and occupying at least one of said openings, said carriage means being rotatable about said center point, whereby said marking element can draw a curved line having a desired radius.

2. The drafting tool of claim 1, further comprising:

locking means on at least one of said carriage means and said track for temporarily fixing said carriage in place on said track.

3. The drafting tool of claim 2, wherein the locking means is operable by contact with the marking element in the carriage means, and engages and releases the carriage means from the track upon insertion and removal of the marking element, respectively.

4. The drafting tool of claim 2, wherein said locking means includes a tooth located on said carriage means for engaging with one of a plurality of notches in said track to temporarily lock said carriage in place on said track.

5. The drafting tool of claim 4, further comprising biasing means located on said carriage means for biasing said tooth into a retracted position out of engagement with said notches.

6. The drafting tool of claim 1, further comprising a marking element, wherein said marking element is a hand-held writing instrument.

7. The drafting tool of claim 1, wherein said rings each have an inner and outer circumference, one of said inner and outer circumferences having a protruding tongue complementary with a groove on an opposing one of the inner and outer circumferences of a next adjacent one of said rings, to rotatably interlock said rings.

8. The drafting tool of claim 7, wherein said tongues or said grooves are provided with nodules for minimizing surface area contact for easing rotation of a ring with respect to an adjacent ring.

9. The drafting tool of claim 7, further comprising a rotatable disk at a center of said concentric rings having a radially disposed passageway alignable with said track, said center disk having one of a circumferentially disposed tongue and groove for mating with an opposing one of a tongue and groove about the inner circumference of an inner-most concentric ring.

10. The drafting tool of claim 9, wherein said concentric rings and said disk are secured in a rectangular base, said base defining a circular opening, said opening having a circumference provided with one of a tongue and groove for mating with an opposing one of a tongue and groove circumferentially disposed about the outer circumference of an outer-most concentric ring, said base having a bottom including anti-skid means.

11. The drafting tool of claim 7, wherein said track has laterally opposed rails and said carriage has laterally opposed guides for engaging the rails, one of said rails and guides comprising tongues, the other of said rails and guides comprising grooves, said tongues being captured within said grooves for securing said carriage means within said track in a manner permitting sliding of said carriage means along said track.

12. A method for drawing curved lines, comprising the steps of:

providing a plurality of interlocked, independently rotatable concentric rings, said rings being rotatable about a center point, each of said rings having a radially extending opening, the radially extending openings of the rings being alignable to define a radial track;

providing carriage means for carrying a marking element, said carriage means being slidable along said track into a position on said track for drawing a curved line of a desired radius;

positioning said carriage means along the track to occupy at least one of said radially extending openings at a desired radius;

inserting the marking element into said carriage means, said marking element bearing upon a surface upon which the curved line is to be drawn;

rotating said carriage means about said center point.

13. The method of claim 12, wherein said curved line is a circle.

14. The method of claim 12, further comprising temporarily locking said carriage means in place on said track at the desired radius.

15. The method of claim 14, wherein said locking step comprises extending a spring biased means from the carriage means into engagement with the track, by contact with the marking element.

16. The method of claim 14, wherein said locking step comprises extending a spring biased tooth in said carriage means into engagement with one of a plurality of notches in said track, said tooth engaging upon insertion of the marking element in said carriage means, said tooth being retracted out of engagement with said notch upon removal of the writing instrument, thereby allowing free movement of the carriage means.

17. The method of claim 12, further comprising rotatably engaging the rings via complementary tongues and grooves, and minimizing surface area contact of the tongues and grooves by providing surface nodules for minimizing friction.

18. The method of claim 12, further comprising fixing the rings in a base, and securing the base against displacement on a surface by providing an anti-skid bottom on the base.

* * * * *